US010042294B2

(12) United States Patent
Saitoh et al.

(10) Patent No.: US 10,042,294 B2
(45) Date of Patent: Aug. 7, 2018

(54) SEPARATION DEVICE, FIXING DEVICE, AND IMAGE FORMING APPARATUS

(71) Applicants: Seiji Saitoh, Kanagawa (JP); Yohhei Watanabe, Kanagawa (JP); Fumihiro Hirose, Kanagawa (JP); Naoto Suzuki, Kanagawa (JP); Takashi Sakamaki, Kanagawa (JP)

(72) Inventors: Seiji Saitoh, Kanagawa (JP); Yohhei Watanabe, Kanagawa (JP); Fumihiro Hirose, Kanagawa (JP); Naoto Suzuki, Kanagawa (JP); Takashi Sakamaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/410,260

(22) Filed: Jan. 19, 2017

(65) Prior Publication Data

US 2017/0235259 A1 Aug. 17, 2017

(30) Foreign Application Priority Data

Feb. 12, 2016 (JP) ..... 2016-024571

(51) Int. Cl.
*G03G 15/20* (2006.01)

(52) U.S. Cl.
CPC ..... *G03G 15/2028* (2013.01)

(58) Field of Classification Search
CPC ..... G03G 15/2085
See application file for complete search history.

(56) References Cited

U.S. PATENT DOCUMENTS 4,929,983 A * 5/1990 Barton ..... G03G 15/2028 271/307
2011/0164904 A1 7/2011 Hirose et al.
2011/0217091 A1 9/2011 Hirose et al.
2012/0014725 A1 1/2012 Seto et al.
2012/0044516 A1 2/2012 Hirose et al.
(Continued)

FOREIGN PATENT DOCUMENTS

JP 2005-338315 12/2005
JP 2009-031759 2/2009
(Continued)

*Primary Examiner* — Victor Verbitsky
(74) *Attorney, Agent, or Firm* — Oblon, McClelland, Maier & Neustadt, L.L.P.

(57) ABSTRACT

A separation device includes a separator that separates a recording medium from a rotator and a plurality of recesses disposed on a conveyance path side face of the separator over which the recording medium is conveyed in a recess span in a recording medium conveyance direction and at least in a conveyance span where the recording medium is conveyed. The plurality of recesses includes a first recess extending in a first extension line that is oblique relative to the recording medium conveyance direction and a second recess being adjacent to the first recess in a direction perpendicular to the recording medium conveyance direction. The second recess extends in a second extension line that is oblique relative to the recording medium conveyance direction and overlaps the first extension line of the first recess in the direction perpendicular to the recording medium conveyance direction to define an overlap span.

15 Claims, 9 Drawing Sheets

(56) References Cited

U.S. PATENT DOCUMENTS

| | | | | |
|---|---|---|---|---|
| 2012/0045260 | A1 | 2/2012 | Yamamoto et al. | |
| 2012/0051805 | A1 | 3/2012 | Suzuki et al. | |
| 2012/0224893 | A1 | 9/2012 | Yamamoto et al. | |
| 2013/0294802 | A1 | 11/2013 | Yamamoto et al. | |
| 2013/0330110 | A1* | 12/2013 | Yoshikawa ..... | G03G 15/2085 399/323 |
| 2014/0212188 | A1 | 7/2014 | Watanabe | |
| 2015/0253708 | A1 | 9/2015 | Hirose et al. | |
| 2015/0261154 | A1 | 9/2015 | Nozawa et al. | |
| 2016/0070218 | A1 | 3/2016 | Hirose et al. | |
| 2016/0124361 | A1 | 5/2016 | Watanabe et al. | |
| 2016/0139549 | A1 | 5/2016 | Nozawa et al. | |
| 2016/0209789 | A1 | 7/2016 | Nozawa et al. | |

FOREIGN PATENT DOCUMENTS

| | | |
|---|---|---|
| JP | 2014-157215 | 8/2014 |
| JP | 2016-090996 | 5/2016 |

* cited by examiner

SEPARATION DEVICE, FIXING DEVICE, AND IMAGE FORMING APPARATUS

CROSS-REFERENCE TO RELATED APPLICATION

This patent application is based on and claims priority pursuant to 35 U.S.C. § 119 to Japanese Patent Application No. 2016-024571, filed on Feb. 12, 2016, in the Japanese Patent Office, the entire disclosure of which is hereby incorporated by reference herein.

BACKGROUND

Technical Field

Exemplary aspects of the present disclosure relate to a separation device, a fixing device, and an image forming apparatus, and more particularly, to a separation device for separating a recording medium from a rotator, a fixing device that incorporates the separation device and fixes a toner image on the recording medium, and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved separation device. In one exemplary embodiment, the separation device includes a separator, disposed downstream from a fixing nip formed between a first rotator and a second rotator in a recording medium conveyance direction, to separate a recording medium bearing a toner image that is ejected from the fixing nip from the first rotator. The separator includes a conveyance path side face over which the recording medium is conveyed, a front end disposed opposite the fixing nip, and a rear end disposed downstream from the front end in the recording medium conveyance direction. A plurality of recesses is disposed on the conveyance path side face of the separator in a recess span defined from the front end to the rear end of the separator in the recording medium conveyance direction and at least in a conveyance span defined by a width of the recording medium in a direction perpendicular to the recording medium conveyance direction. The recording medium is conveyed over the conveyance span. The plurality of recesses includes a first recess extending in a first extension line that is oblique relative to the recording medium conveyance direction and a second recess being adjacent to the first recess in the direction perpendicular to the recording medium conveyance direction and extending in a second extension line that is oblique relative to the recording medium conveyance direction. The second extension line overlaps the first extension line in the direction perpendicular to the recording medium conveyance direction to define an overlap span.

This specification describes below an improved fixing device. In one exemplary embodiment, the fixing device includes a first rotator disposed opposite a toner image on a recording medium and a second rotator pressed against the first rotator to form a fixing nip between the first rotator and the second rotator. The recording medium is conveyed through the fixing nip. A separator is disposed downstream from the fixing nip in a recording medium conveyance direction to separate the recording medium ejected from the fixing nip from the first rotator. The separator includes a conveyance path side face over which the recording medium is conveyed, a front end disposed opposite the fixing nip, and a rear end disposed downstream from the front end in the recording medium conveyance direction. A plurality of recesses is disposed on the conveyance path side face of the separator in a recess span defined from the front end to the rear end of the separator in the recording medium conveyance direction and at least in a conveyance span defined by a width of the recording medium in a direction perpendicular to the recording medium conveyance direction. The recording medium is conveyed over the conveyance span. The plurality of recesses includes a first recess extending in a first extension line that is oblique relative to the recording medium conveyance direction and a second recess being adjacent to the first recess in the direction perpendicular to the recording medium conveyance direction and extending in a second extension line that is oblique relative to the recording medium conveyance direction. The second extension line overlaps the first extension line in the direction perpendicular to the recording medium conveyance direction to define an overlap span.

This specification further describes an improved image forming apparatus. In one exemplary embodiment, the image forming apparatus includes an image forming device to form a toner image and a fixing device disposed downstream from the image forming device in a recording medium conveyance direction to fix the toner image on a recording medium. The fixing device includes a first rotator disposed opposite the toner image on the recording medium and a second rotator pressed against the first rotator to form a fixing nip between the first rotator and the second rotator. The recording medium is conveyed through the fixing nip. A separator is disposed downstream from the fixing nip in the recording medium conveyance direction to separate the recording medium ejected from the fixing nip from the first rotator. The separator includes a conveyance path side face over which the recording medium is conveyed, a front end disposed opposite the fixing nip, and a rear end disposed downstream from the front end in the recording medium conveyance direction. A plurality of recesses is disposed on the conveyance path side face of the separator in a recess span defined from the front end to the rear end of the separator in the recording medium conveyance direction and at least in a conveyance span defined by a width of the recording medium in a direction perpendicular to the recording medium conveyance direction. The recording medium is conveyed over the conveyance span. The plurality of recesses includes a first recess extending in a first extension line that is oblique relative to the recording medium conveyance direction and a second recess being adjacent to the first recess in the direction perpendicular to the recording medium conveyance direction and extending in a second extension line that is oblique relative to the recording medium conveyance direction. The second extension line overlaps the first extension line in the direction perpendicular to the recording medium conveyance direction to define an overlap span.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
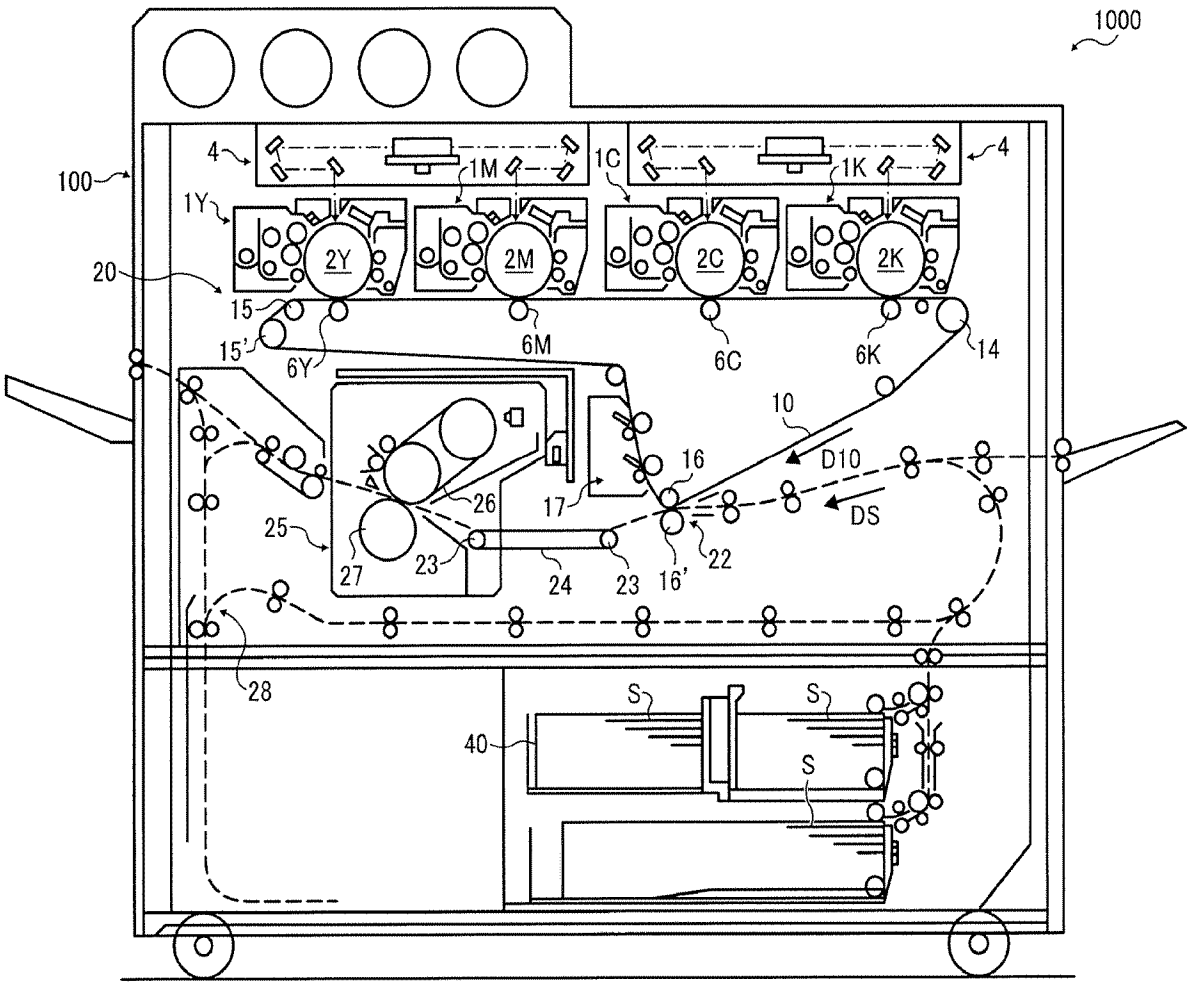
FIG. 1 is a schematic vertical cross-sectional view of an image forming apparatus according to an exemplary embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 1000 according to an exemplary embodiment is explained.

FIG. 1 is a schematic vertical cross-sectional view of the image forming apparatus 1000. The image forming apparatus 1000 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1000 is a color printer that forms color and monochrome toner images on a recording medium by electrophotography. Alternatively, the image forming apparatus 1000 may be a monochrome printer that forms a monochrome toner image on a recording medium.

Referring to FIG. 1, a description is provided of a construction of the image forming apparatus 1000.

As illustrated in FIG. 1, the image forming apparatus 1000 is a printer employing a tandem intermediate transfer method. The image forming apparatus 1000 includes a body 100 and a sheet feeder 40 mounting the body 100. An intermediate transfer belt 10, that is, an endless belt, is situated in a center portion of the body 100. Above the intermediate transfer belt 10 is an image forming device 20. The intermediate transfer belt 10 is looped over a plurality of support rollers 14, 15, 15', and 16 and rotatable clockwise in FIG. 1 in a rotation direction D10. The support roller 14 is a driving roller that drives and rotates the intermediate transfer belt 10. On the left of the support roller 16 is an intermediate transfer belt cleaner 17. The intermediate transfer belt cleaner 17 removes residual toner failed to be transferred onto a sheet S and therefore remaining on the intermediate transfer belt 10 therefrom. Above the intermediate transfer belt 10, which is stretched taut across the support rollers 14 and 15, are four image forming units 1Y, 1M, 1C, and 1K being aligned in the rotation direction D10 of the intermediate transfer belt 10 and constructing the tandem image forming device 20. Suffixes Y, M, C, and K represent yellow, magenta, cyan, and black, respectively. The image forming units 1Y, 1M, 1C, and 1K include photoconductive drums 2Y, 2M, 2C, and 2K serving as image bearers that bear yellow, magenta, cyan, and black toner images, respectively. In a print job to form a black toner image on the intermediate transfer belt 10, the support rollers 15 and 15" move to isolate the intermediate transfer belt 10 from the photoconductive drums 2Y, 2M, and 2C.

Above the image forming device 20 are two exposure devices 4. The left exposure device 4 corresponds to the two image forming units 1Y and 1M. The right exposure device 4 corresponds to the two image forming units 1C and 1K. Each of the exposure devices 4 employs an optical scanning method and includes two light sources (e.g., a semiconductor laser, a semiconductor laser array, or a multi-beam light source), a coupling optical system, a common optical deflector (e.g., a polygon mirror), and two scanning-image forming optical systems. The exposure devices 4 expose the photoconductive drums 2Y, 2M, 2C, and 2K according to yellow, magenta, cyan, and black image data, forming electrostatic latent images on the photoconductive drums 2Y, 2M, 2C, and 2K, respectively.

Each of the photoconductive drums 2Y, 2M, 2C, and 2K is surrounded by a developing device that visualizes the electrostatic latent image into a visible toner image, that is, yellow, magenta, cyan, and yellow toner images, and other components. Since the yellow, magenta, cyan, and black toner images are formed through general image forming processes, a detailed description of the image forming processes is omitted. Primary transfer rollers 6Y, 6M, 6C, and 6K are disposed opposite the photoconductive drums 2Y, 2M, 2C, and 2K via the intermediate transfer belt 10 to form primary transfer nips between the photoconductive drums 2Y, 2M, 2C, and 2K and the intermediate transfer belt 10, respectively, where the yellow magenta, cyan, and black toner images formed on the photoconductive drums 2Y, 2M, 2C, and 2K are primarily transferred onto the intermediate transfer belt 10 as a color toner image.

A secondary transfer device 22 is disposed opposite the image forming device 20 via the intermediate transfer belt 10. The secondary transfer device 22 includes a secondary transfer roller 16' pressed against the support roller 16 serving as a secondary transfer opposed roller via the intermediate transfer belt 10. The secondary transfer roller 16' generates a transfer electric field to secondarily transfer the color toner image formed on the intermediate transfer belt 10 onto a sheet S serving as a recording medium conveyed from the sheet feeder 40.

Downstream from the secondary transfer device 22 in a sheet conveyance direction DS is a fixing device 25 that fixes the color toner image transferred from the intermediate transfer belt 10 onto the sheet S thereon. The fixing device 25 includes a fixing belt 26 serving as an endless belt and a pressure roller 27 pressed against the fixing belt 26. The fixing belt 26 is looped over two support rollers. A heater (e.g., a lamp or an induction heater employing an electromagnetic induction heating method) is disposed inside at least one of the support rollers.

A conveyance belt 24 supported by two rollers 23 conveys the sheet S bearing the color toner image transferred from the intermediate transfer belt 10 to the fixing device 25. Instead of the conveyance belt 24, a stationary guide, a conveyance roller, or the like may be used.

Below the secondary transfer device 22 and the fixing device 25 is a sheet reverse device 28 disposed in parallelism with the image forming device 20. The sheet reverse device 28 reverses and conveys the sheet S for duplex printing to print another toner image on a back side of the sheet S.

A description is provided of a construction of the fixing device 25 incorporated in the image forming apparatus 1000 having the construction described above.

Figure 2:
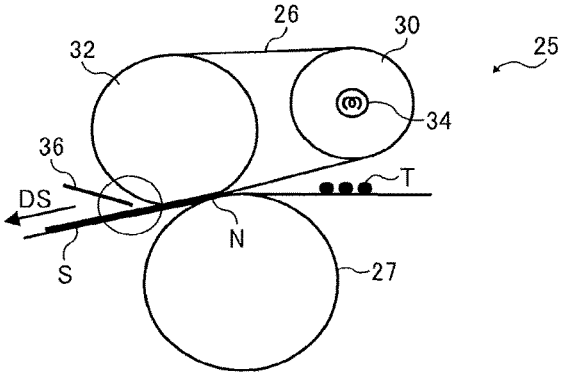
FIG. 2 is a vertical cross-sectional view of a fixing device incorporated in the image forming apparatus depicted in FIG. 1.

FIG. 2 is a schematic vertical cross-sectional view of the fixing device 25. As illustrated in FIG. 2, the fixing device 25 (e.g., a fuser or a fusing unit) includes a heating roller 30, a fixing roller 32, the fixing belt 26 being stretched taut across the heating roller 30 and the fixing roller 32 and facing a toner image T on a sheet S, the pressure roller 27 pressed against the fixing roller 32 via the fixing belt 26 to form a fixing nip N between the fixing belt 26 and the pressure roller 27, and a separation plate 36 disposed downstream from the fixing nip N in the sheet conveyance direction DS. The separation plate 36 serves as a separator that separates the sheet S from the fixing belt 26. The fixing roller 32 or the fixing bell 26 serves as a first rotator. The pressure roller 27 serves as a second rotator.

A detailed description is now given of a construction of the fixing belt 26.

The fixing belt 26 is a multi-layer endless belt constructed of a base layer, an elastic layer coating the base layer, and a release layer coating the elastic layer. The base layer, having a layer thickness of about 90 micrometers, is made of polyimide (PI) resin. The elastic layer is made of silicone rubber or the like. The elastic layer, having a layer thickness in a range of from about 200 micrometers to about 500 micrometers, is made of an elastic material such as silicone rubber, fluoro rubber, and silicone rubber foam. The release layer, having a layer thickness of about 20 micrometers, is made of tetrafluoroethylene-perfluoroalkylvinylether copolymer (PFA), polyimide (PI), polyether imide (PEI), polyether sulfide (PES), or the like. The release layer serving as a surface layer of the fixing belt 26 facilitates separation or peeling-off of toner of the toner image T on the sheet S from the fixing belt 26.

A detailed description is now given of a construction of the heating roller 30, the fixing roller 32, and the pressure roller 27.

The heating roller 30 is a thin tube made of metal, for example. Each of the fixing roller 32 and the pressure roller 27 is a tube constructed of a cored bar made of metal and an elastic layer coating the cored bar and made of fluoro rubber, silicone rubber, silicone rubber foam, or the like. At least the heating roller 30 accommodates a heater 34 serving as a heater or a heat source. The heating roller 30 heats the fixing belt 26 which in turn heats the sheet S bearing the unfixed toner image T while the sheet S contacts an outer circumferential surface of the fixing belt 26, thus fixing the toner image T on the sheet S.

A description is provided of a configuration of a comparative fixing device incorporating a mechanism to separate a sheet ejected from a fixing nip formed between a fixing rotator and a pressure rotator from the fixing rotator.

The comparative fixing device includes a separator (e.g., a separation claw and a separation plate) disposed in proximity to an exit of the fixing nip to separate a leading edge of the sheet from the fixing rotator. Hence, as toner of a toner image formed on the sheet, while the toner retains heat received from the fixing rotator, comes into contact with the separator, half melted toner on the sheet may slide over the separator, rendering the separator to damage the toner image on the sheet.

To address this circumstance, the separator may include a plurality of separation plates having front edges aligned in parallelism with an axial direction of the fixing rotator. A positioner disposed at each lateral end of the separator abuts on the fixing rotator in a non-conveyance span on the fixing rotator where the sheet is not conveyed. An adjuster adjusts a gap between the front edge of the separation plate and the fixing rotator to be constant.

However, since an interval is provided between the adjacent separation plates, the sheet of a type susceptible to deformation may strike the separation plate with substantial impact, causing failures such as gloss streaks or scratches on the toner image on the sheet and creases on the sheet. To address this circumstance, the number of the separation plates may be increased. However, it takes substantial time to adjust the gap between each separation plate and the fixing rotator.

Alternatively, the separator may include a single plate extending in a longitudinal direction perpendicular to a sheet conveyance direction. However, the gap between each separation plate and the fixing rotator may increase to enhance precision of parts, degrading separation of the sheet having a decreased leading margin from the fixing rotator. Additionally, as the fixing rotator expands thermally, the sheet may not strike the separator with even pressure, degrading the toner image on the sheet.

Figure 3A:
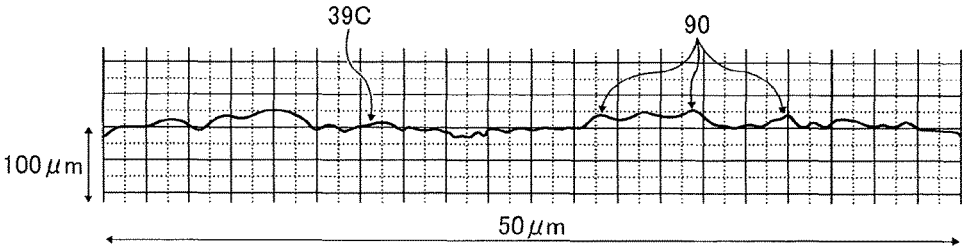
FIG. 3A is a diagram illustrating a comparative front end profile, in a direction perpendicular to a surface of a sheet, of comparative recesses mounted on a conveyance path side face of a comparative separation plate.
Figure 3B:
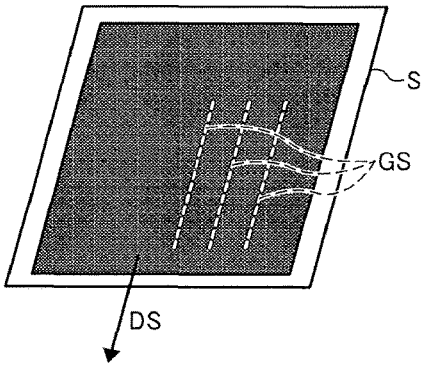
FIG. 3B is a perspective view of the sheet illustrating gloss streaks thereon produced by peculiar projections mounted on the conveyance path side face of the comparative separation plate depicted in FIG. 3A.

Regardless of whether the separator includes a single separation plate or a plurality of separation claws, each of which has a decreased width, a front end of the separator of the comparative fixing device may have local peculiar projections 90 as illustrated in FIG. 3A, which may be caused by variation in processing of parts. FIG. 3A is a diagram illustrating a comparative front end profile, in a direction perpendicular to a surface of the sheet S, of comparative recesses 39C mounted on a conveyance path side face of a comparative separation plate. As a solid toner image on the sheet S strikes the peculiar projections 90 with substantial impact, the peculiar projections 90 may produce gloss streaks and scratches on the solid toner image on the sheet S as illustrated in FIG. 3B. FIG. 3B is a perspective view of the sheet S, illustrating gloss streaks GS thereon produced by the peculiar projections 90 depicted in FIG. 3A. Even if the front end of the separator is processed with enhanced precision and a surface of a front edge of the separator is smoothed, the sheet S may slide over the separator with increased resistance or friction therebetween and may be caught in a gap between the separator and the fixing rotator, thus being jammed between the separator and the fixing rotator.

A detailed description is now given of a construction of the separation plate 36 incorporated in the fixing device 25.

As illustrated in FIG. 2, the separation plate 36, serving as a separator or a recording medium separator, is disposed downstream from the fixing nip N in the sheet conveyance direction DS and disposed opposite the fixing roller 32 via the fixing belt 26. As the sheet S is ejected from the fixing nip N, the separation plate 36 separates a leading end of the sheet S from the fixing belt 26. The sheet S is conveyed to an output tray located outside the body 100 of the image forming apparatus 1000 or the sheet reverse device 28 depicted in FIG. 1. Optionally, another separation plate may be disposed opposite the pressure roller 27.

The separation plate 36 may include a plurality of separation claws, each of which has a decreased width in a longitudinal direction of the separation plate 36 perpendicular to the sheet conveyance direction DS, arranged in parallelism with each other. However, in order to allow the separation plate 36 to contact the sheet S evenly, the separation plate 36 includes a single plate extending in the longitudinal direction of the separation plate 36. The separation plate 36 has a length in the longitudinal direction thereof that is greater than a conveyance span (e.g., a maximum image span) on the fixing belt 26 in an axial direction thereof parallel to the longitudinal direction of the separation plate 36 where the sheet S is conveyed. In order to address disadvantages of a single plate, the separation plate 36 has a construction described below.

Figure 4:
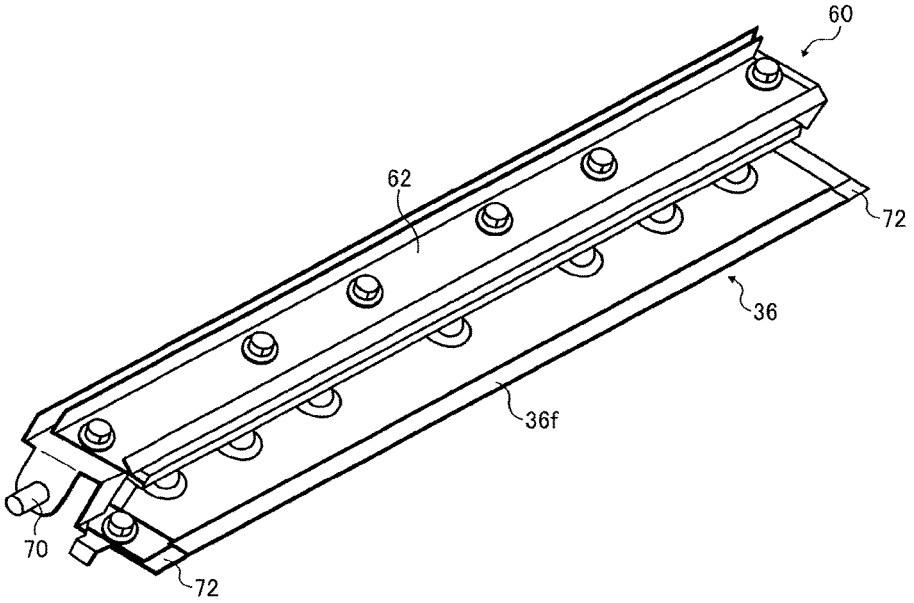
FIG. 4 is a perspective view of a separation device incorporated in the fixing device depicted in FIG. 2.

FIG. 4 is a perspective view of a separation device 60 incorporated in the fixing device 25. As illustrated in FIG. 4, the separation device 60 includes the separation plate 36, a stay 62, a positioning pin 70, and an abutment plate 72. The separation plate 36 is a single plate attached to the stay 62 serving as a support that supports the separation plate 36.

Figure 5:
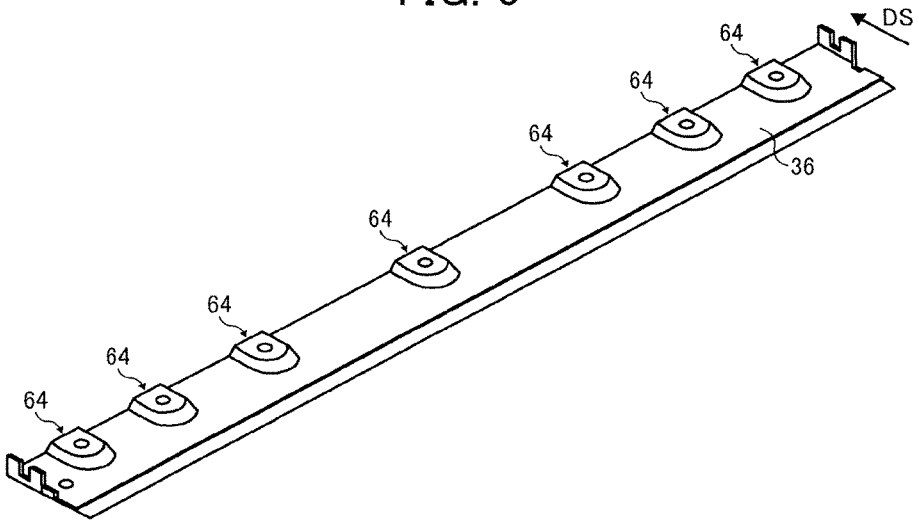
FIG. 5 is a perspective view of a separation plate incorporated in the separation device depicted in FIG. 4.

FIG. 5 is a perspective view of the separation plate 36. As illustrated in FIG. 5, the separation plate 36 mounts a plurality of projections 64 disposed in a downstream end of the separation plate 36 in the sheet conveyance direction DS. Thus, the separation plate 36, the stay 62, the positioning pin 70, the abutment plate 72, and the projections 64 construct the separation device 60 serving as a separation device or a recording medium separation device.

Figure 6:
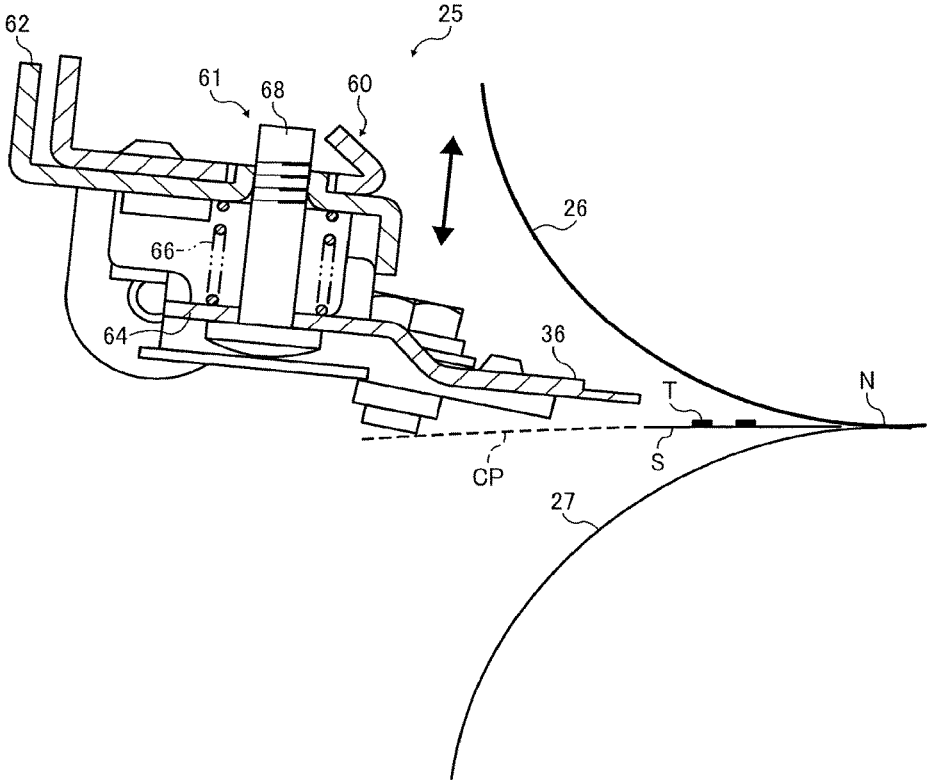
FIG. 6 is a cross-sectional view of the separation device depicted in FIG. 4.

FIG. 6 is a cross-sectional view of the separation device 60. As illustrated in FIG. 6, the projections 64 project in a direction in which the projections 64 separate from a conveyance path CP where the sheet S is conveyed.

Figure 7:
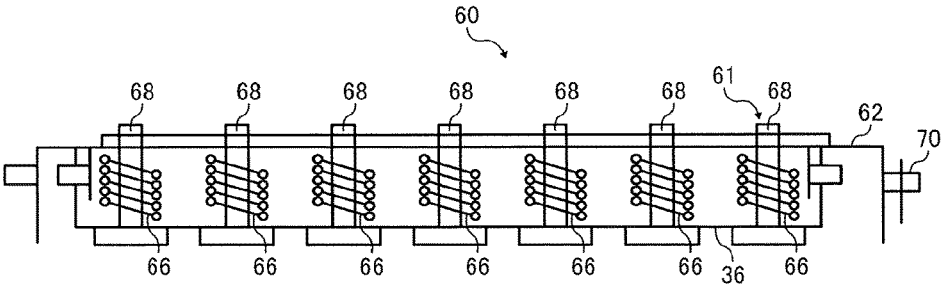
FIG. 7 is a side view of the separation device depicted in FIG. 6, illustrating a position adjuster incorporated therein.

The separation device 60 further includes a position adjuster 61 interposed between the stay 62 and each of the projections 64 mounted on the separation plate 36. The position adjuster 61 includes a spring 66 and a screw 68. FIG. 7 is a side view of the separation device 60, illustrating the position adjuster 61. As illustrated in FIGS. 4 and 7, as the positioning pin 70 swaged in each lateral end of the stay 62 in a longitudinal direction thereof is inserted into a through-hole of a frame of the fixing device 25, the separation device 60 is held by and positioned inside the fixing device 25. As illustrated in FIG. 4, the abutment plate 72 abuts on each lateral end of the separation plate 36 in the longitudinal direction thereof and is disposed opposite a non-conveyance span on the fixing belt 26 where the sheet S is not conveyed. As a front edge of the abutment plate 72 contacts the fixing belt 26, the abutment plate 72 positions the separation plate 36 with respect to the fixing belt 26.

The separation plate 36 is a metal plate made of heat resistant plastic or SUS stainless steel. The separation plate 36 includes a thin sheet, that is, a sheet-shaped front end 36*f*, having a thickness of about 0.4 mm, for example, to reduce a gap between the separation plate 36 and the fixing nip N.

A description is provided of a configuration of the separation plate 36 which has the sheet-shaped front end 36*f*.

Figure 8A:
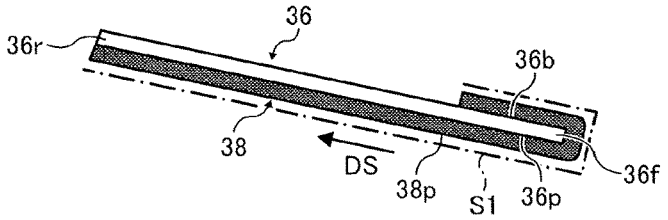
FIG. 8A is a cross-sectional view of the separation plate depicted in FIG. 5, illustrating a recess span.

FIG. 8A is a cross-sectional view of the separation plate 36. FIG. 8A illustrates a recess span S1 in a dashed line. FIG.

Figure 8B:
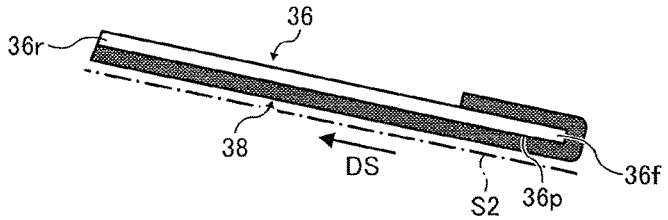
FIG. 8B is a cross-sectional view of the separation plate depicted in FIG. 5, illustrating another recess span.

8B is a cross-sectional view of the separation plate 36. FIG. 8B illustrates a recess span S2 in a dashed line. As illustrated in FIG. 8A, the separation plate 36 includes a conveyance path side face 36*p* provided with a tape 38 that coats the separation plate 36 such that the tape 38 is folded at a front edge of the separation plate 36, that is disposed opposite the fixing nip N. The separation plate 36 further includes a fixing belt side face 36*b*, serving as a first rotator side face, provided with the tape 38. The tape 38 is adhered to the separation plate 36 to coat the separation plate 36, thus serving as a surface layer of the separation plate 36. The tape 38 is made of fluoro resin such as Teflon® that facilitates sliding of the sheet S over the tape 38 and separation of the sheet S from the tape 38. A combined thickness of the tape 38 and the front end 36*f* of the separation plate 36 is suppressed to about 0.6 mm, thus reducing the gap between the separation plate 36 and the fixing nip N.

The tape 38 serving as the surface layer of the separation plate 36 is provided with a plurality of recesses. As illustrated in FIG. 8B, the recesses of the tape 38 may be disposed in the recess span S2 on the conveyance path side face 36*p* of the separation plate 36 that is disposed opposite the conveyance path CP. Alternatively, as illustrated in FIG. 8A, the recesses of the tape 38 may be disposed in the recess span S1 on the conveyance path side face 36*p* and the fixing belt side face 36*b* of the separation plate 36 that is disposed opposite the fixing belt 26. The fixing belt side face 36*b* is a counter side of the conveyance path side face 36*p*. Thus, the recesses of the tape 38 turn at the front edge of the separation plate 36 that is disposed opposite the fixing nip N. If the recesses are produced on the tape 38 after the tape 38 is adhered to the separation plate 36, the recesses are produced on the conveyance path side face 36*p* readily.

Figure 9A:
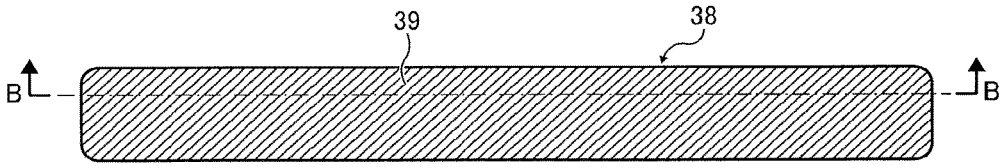
FIG. 9A is a plan view of a tape disposed on a conveyance path side face of the separation plate depicted in FIGS. 8A and 8B.
Figure 9B:
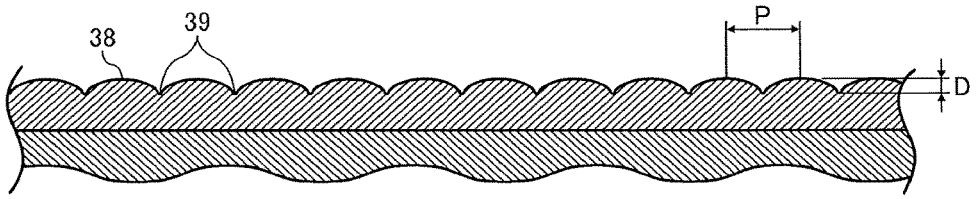
FIG. 9B is a partial cross-sectional view of the tape taken on line B-B in FIG. 9A.

FIG. 9A is a plan view of the tape 38 disposed on the conveyance path side face 36*p*. FIG. 9B is a partial cross-sectional view of the tape 38 taken on line B-B in FIG. 9A. FIG. 9B illustrates a plurality of recesses 39 unproportionally. As illustrated in FIGS. 8A and 9A, the recesses 39 are disposed on the tape 38 adhered at least to the entire conveyance path side face 36*p* of the separation plate 36 in a recess span defined from the front end 36*f* of the separation plate 36 that is disposed opposite the fixing nip N to a rear end 36*r* of the separation plate 36 in the sheet conveyance direction DS. Alternatively, the recesses 39 may be disposed at least on the conveyance path side face 36*p* of the separation plate 36 in the recess span defined from the front end 36*f* of the separation plate 36 that is disposed opposite the fixing nip N to the rear end 36*r* of the separation plate 36 in the sheet conveyance direction DS.

The recesses 39 are aligned obliquely with each other and regularly to create a plurality of elongated straight lines at least in a conveyance span of the separation plate 36 in a width direction of the sheet S perpendicular to the sheet conveyance direction DS where the sheet S is conveyed. Each recess 39 extends to a front edge of a conveyance path side face 38*p* of the tape 38. Each recess 39 is a depression defined by a wall having a height that decreases at a front end of the recess 39 that faces the fixing nip N. Each recess 39 is open at the front end of the recess 39. The front end of the recess 39 that has the decreased height may have one or more steps. The plurality of recesses 39 that is narrow and elongated is situated on the separation plate 36 or the tape 38, reducing resistance or friction between the sheet S and the separation plate 36 while the separation plate 36 separates the sheet S ejected from the fixing nip N from the fixing belt 26 and thereby improving conveyance of the sheet S.

A contact state in which the sheet S contacts the separation plate 36 changes according to various conditions such as a property of the sheet S (e.g., thickness, rigidity, grain, and smoothness of the sheet S), the toner image T formed on the sheet S, the conveyance speed at which the sheet S is conveyed through the fixing nip N, the target fixing temperature at which the toner image T is fixed on the sheet S, the print mode, and the conveyance condition in which the sheet S is conveyed after the sheet S passes over the separation plate 36. For example, the contact state in which the sheet S contacts the separation plate 36 varies as illustrated in FIGS. 10A, 10B, 10C, and 10D.

Figure 10A:
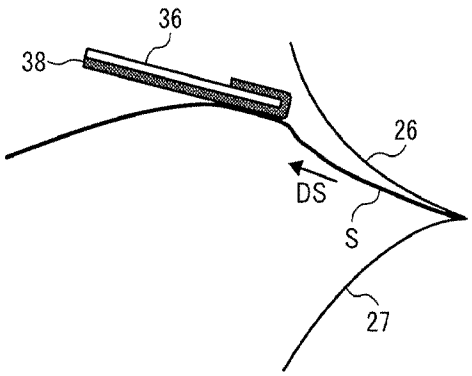
FIG. 10A is a cross-sectional view of the separation plate depicted in FIGS. 8A and 8B and a sheet conveyed while the sheet contacts a front end portion of the separation plate.
Figure 10B:
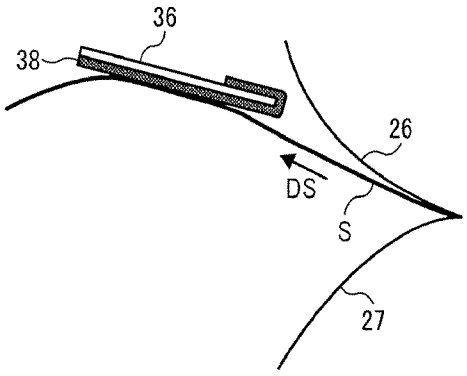
FIG. 10B is a cross-sectional view of the separation plate depicted in FIGS. 8A and 8B and a sheet conveyed while the sheet contacts an intermediate portion of the separation plate.
Figure 10C:
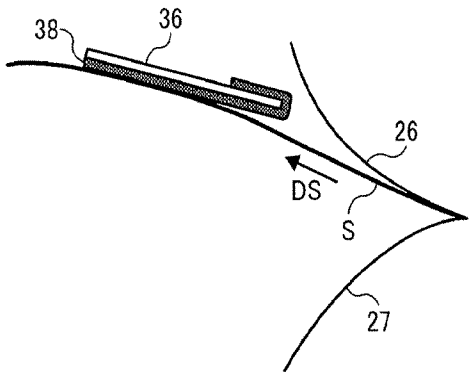
FIG. 10C is a cross-sectional view of the separation plate depicted in FIGS. 8A and 8B and a sheet conveyed while the sheet contacts a rear end portion of the separation plate.
Figure 10D:
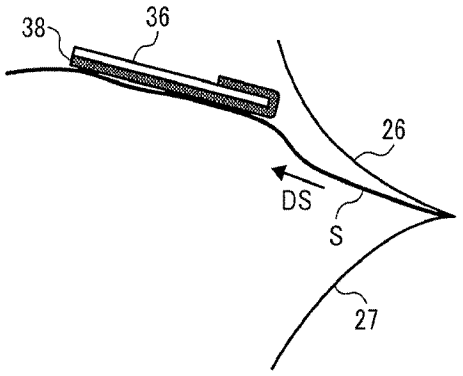
FIG. 10D is a cross-sectional view of the separation plate depicted in FIGS. 8A and 8B and a sheet conveyed while the sheet contacts an entire portion of the separation plate.

FIG. 10A is a cross-sectional view of the separation plate 36 and the sheet S conveyed while the sheet S contacts a front end portion of the separation plate 36, which is in proximity to the fixing nip N. FIG. 10B is a cross-sectional view of the separation plate 36 and the sheet S conveyed while the sheet S contacts an intermediate portion of the separation plate 36, which is disposed downstream from the front end portion in the sheet conveyance direction DS. FIG. 10C is a cross-sectional view of the separation plate 36 and the sheet S conveyed while the sheet S contacts a rear end portion of the separation plate 36, which is disposed downstream from the intermediate portion in the sheet conveyance direction DS. FIG. 10D is a cross-sectional view of the separation plate 36 and the sheet S conveyed while the sheet S contacts an entire portion of the separation plate 36 in the sheet conveyance direction DS.

In order to correspond to the contact state in which the sheet S contacts the separation plate 36, which varies as illustrated in FIGS. 10A, 10B, 10C, and 10D, the recesses 39 extend throughout an entire span of the separation plate 36 in the sheet conveyance direction DS, thus reducing resistance or friction between the sheet S and the separation plate 36 in each of the contact states illustrated in FIGS. 10A, 10B, 10C, and 10D and improving conveyance of the sheet S. For example, when the sheet S is conveyed in the contact state in which the sheet S contacts the entire portion of the separation plate 36 in the sheet conveyance direction DS as illustrated FIG. 10D, resistance or friction between the sheet S and the separation plate 36 increases compared to the contact states illustrated in FIGS. 10A, 10B, and 10C. Accordingly, an advantage attained by the recesses 39 under the contact state illustrated in FIG. 10D is greater than an advantage attained by the recesses 39 under the contact states illustrated in FIGS. 10A, 10B, and 10C.

As illustrated in FIG. 9A, the narrow, elongated recesses 39 are disposed in an entire span in the sheet conveyance direction DS of the tape 38 that is adhered to the conveyance path side face 36*p* of the separation plate 36 such that the recess 39 is regularly aligned with the adjacent recess 39 with a pitch not greater than 1.2 mm in a direction perpendicular to the sheet conveyance direction DS. The recesses 39 are treated with or processed by deburring press, eliminating peculiar projections. Accordingly, the recesses 39 prevent the sheet S from contacting the tape 38 partially, suppressing formation of gloss streaks on the toner image T on the sheet S.

As illustrated in FIG. 9B, according to this exemplary embodiment, the recess 39 is aligned with the adjacent recess 39 with a pitch P of 0.5 mm therebetween. If the pitch P is greater than 1.2 mm, the recesses 39 may produce image streaks aligned with each other with the pitch P of 1.2 mm on the toner image T on the sheet S. Conversely, if the pitch P is not greater than 1.2 mm, the recesses 39 do not cause image failure. The recesses 39 aligned with the pitch P of 1.2 mm produce a depression of 0.6 mm and a projection of 0.6 mm in cross-section. Alternatively, the recesses 39 may produce a depression of 0.3 mm and a projection of 0.9 mm or a depression of 0.9 mm and a projection of 0.3 mm in cross-section. The slight recess 39 has a depth not smaller than 5 micrometers.

According to this exemplary embodiment, the recess 39 has a depth D of about 20 micrometers (e.g., 20 micrometers plus and minus 5 micrometers). In FIG. 9B, the recess 39 is not illustrated in a proportional scale between a vertical and a horizontal. A bottom or a trough of the recess 39 may thermally expand into a bulge under heat from the fixing belt 26. To address this circumstance, the recess 39 has the depth D not smaller than 5 micrometers to retain an appropriate recess shape even when the recess 39 is subject to thermal expansion. Accordingly, the recess 39 may have the depth D of 50 micrometers, for example. Alternatively, the slight recesses 39 may be produced on the separation plate 36 directly, not by attaching the tape 38 provided with the recesses 39 to the separation plate 36.

Figure 11:
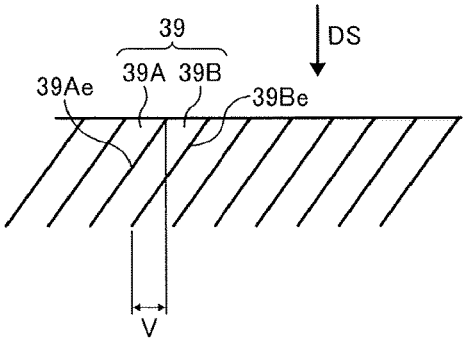
FIG. 11 is a partial plan view of recesses mounted on the separation plate depicted in FIGS. 8A and 8B.

FIG. 11 is a partial plan view of the recesses 39. As illustrated in FIG. 11, each of the slight recesses 39 mounted on the conveyance path side face 36*p* of the separation plate 36 or the conveyance path side face 38*p* of the tape 38 extends obliquely relative to the sheet conveyance direction DS in an extension line that is straight. For example, an extension line 39Ae of a first recess 39A and an extension line 39Be of a second recess 39B adjacent to the first recess 39A overlap in the direction perpendicular to the sheet conveyance direction DS to define an overlap span V. The extension lines 39Ae and 39Be define lines produced on the tape 38 or a surface of the separation plate 36 by the first recess 39A and the second recess 39B, respectively. The extension lines 39Ae and 39Be of the first recess 39A and the second recess 39B, respectively, that extend obliquely relative to the sheet conveyance direction DS, bring the plurality of projections, each of which is between the adjacent extension lines 39Ae and 39Be, into contact with the sheet S evenly, preventing formation of pitch streaks on the toner image T on the sheet S.

Each of the recesses 39 is inclined relative to the sheet conveyance direction DS by 30 degrees, 45 degrees, or 60 degrees. However, the adjacent recesses 39 overlap in the overlap span V in the direction perpendicular to the sheet conveyance direction DS. The recesses 39 are formed in oblique, straight lines as illustrated in FIG. 11. Alternatively, the recesses 39 may be formed in a wave, a V-shape, an X-shaped, or a C-shape, for example.

Figure 12:
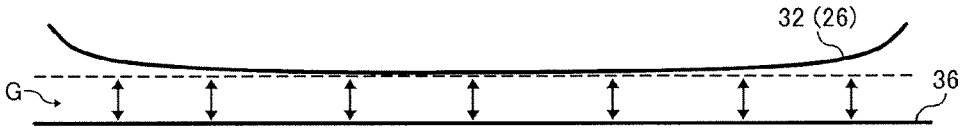
FIG. 12 is a plan view of the separation plate, a fixing belt, and a fixing roller that are incorporated in the fixing device depicted in FIG. 2 when a sheet is centered in an axial direction of the fixing belt in a center conveyance system.
Figure 13:
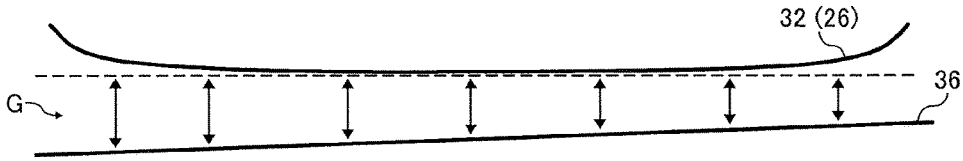
FIG. 13 is a plan view of the separation plate, the fixing belt, and the fixing roller that are incorporated in the fixing device depicted in FIG. 2 when a sheet is aligned at one lateral end of the fixing belt in the axial direction thereof in a lateral end conveyance system.

FIG. 12 is a plan view of the separation plate 36, the fixing belt 26, and the fixing roller 32 when the sheet S is centered in the axial direction of the fixing belt 26 in a center conveyance system. FIG. 13 is a plan view of the separation plate 36, the fixing belt 26, and the fixing roller 32 when the sheet S is aligned at one lateral end of the fixing belt 26 in the axial direction thereof in a lateral end conveyance system.

In the image forming apparatus 1000 employing the center conveyance system in which the sheet S is centered on the fixing belt 26 in the axial direction thereof as the sheet S is conveyed over the fixing belt 26, as illustrated in FIG. 12, the separation plate 36 is installed in the fixing device 25 such that a gap G between the front edge (e.g., the front end 36*f*) of the separation plate 36 and the fixing belt 26 or the fixing roller 32 increases from a center to each lateral end of the separation plate 36 in the longitudinal direction thereof. An external form of the fixing roller 32 is subject to thermal expansion. To address this circumstance, thermal expansion of the fixing roller 32 is measured with a laser displacement meter in advance during design evaluation. When the sheet S is centered on the fixing belt 26 in the axial direction thereof in the center conveyance system, the fixing roller 32 may thermally expand symmetrically in an axial direction of the fixing roller 32. For example, a center of the fixing roller 32 in the axial direction thereof may thermally expand substantially. To address this circumstance, the front edge of the separation plate 36 is retained in parallelism with the axial direction of the fixing roller 32.

Conversely, when the sheet S is aligned at one lateral end on the fixing belt 26 in the axial direction thereof in the lateral end conveyance system while the sheet S is conveyed over the fixing belt 26, one lateral end of the fixing roller 32 in the axial direction thereof may not thermally expand symmetrically with another lateral end of the fixing roller 32 in the axial direction thereof. To address this circumstance, the front edge of the separation plate 36 is retained in inclination with the axial direction of the fixing roller 32 as illustrated in FIG. 13 such that the gap G between the separation plate 36 and the fixing roller 32 increases in the axial direction of the fixing roller 32.

A description is provided of one example of a method for manufacturing the narrow, elongated recesses 39 on the conveyance path side face 36*p* of the separation plate 36 at least in the conveyance span of the separation plate 36 in the longitudinal direction of the separation plate 36 where the sheet S is conveyed over the separation plate 36.

Figure 14:
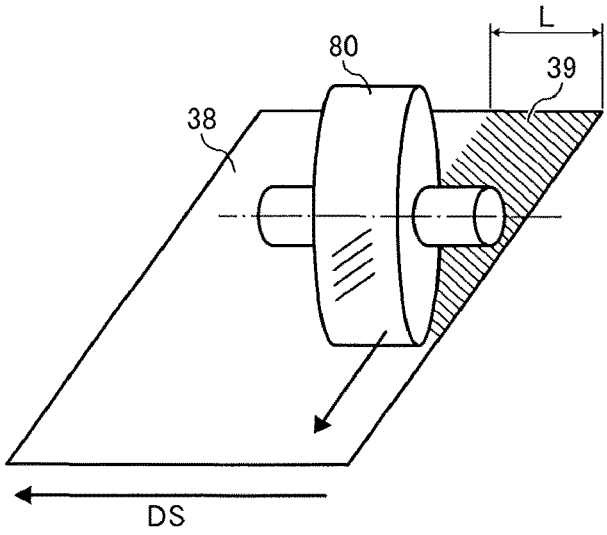
FIG. 14 is a perspective view of a tape and recesses being produced on the tape, which define a length greater than a length of a specialized tool.

FIG. 14 is a perspective view of the tape 38 and the recesses 39. As illustrated in FIG. 14, before the tape 38 is adhered to the separation plate 36, a specialized tool 80 transfers recesses onto an outer face of the tape 38 by deburring press. Thus, peculiar projections are produced as the tape 38 is adhered to the separation plate 36, facilitating processing of the recesses 39. For example, the specialized tool 80 is a metal tube having an outer circumferential face mounting a plurality of projections extending regularly and obliquely in a teeth shape. For example, a knurling tool (e.g., a knurled roller) or the like that is commercially available to make knurls is used as the specialized tool 80.

A length of the specialized tool 80 in the sheet conveyance direction DS does not restrict a length L of the recesses 39. If the length of the specialized tool 80 in the sheet conveyance direction DS is smaller than the length L of the recesses 39, deburring press is performed a plurality of times to produce a plurality of rows of the recesses 39 in a predetermined span. In this case, a narrow gap may be provided between the adjacent rows of the recesses 39. Conversely, if the length of the specialized tool 80 in the sheet conveyance direction DS is equivalent to or greater than the length L of the recesses 39, deburring press is performed once to produce a single row of the recesses 39.

Figure 15:
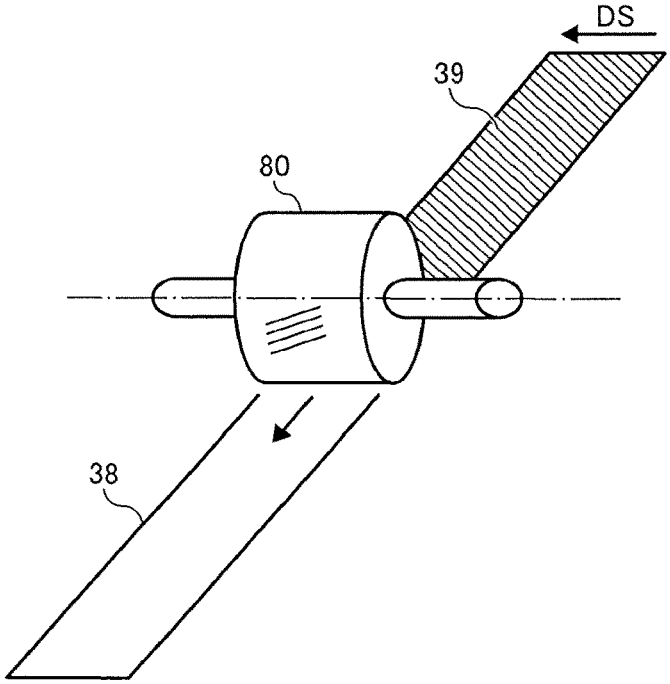
FIG. 15 is a perspective view of a tape and recesses being produced on the tape, which define a length equivalent to or smaller than the length of the specialized tool.

FIG. 15 is a perspective view of the tape 38 and the recesses 39. Alternatively, as illustrated in FIG. 15, the recesses 39 having the length L being greater than a finished length of the tape 38 in the sheet conveyance direction DS may be produced on the tape 38 with the specialized tool 80. The tape 38 may be cut to have the finished length in the sheet conveyance direction DS. The recesses 39 are produced on the tape 38 throughout an entire span of the tape 38 in a width direction thereof perpendicular to the sheet conveyance direction DS. Accordingly, the tape 38 is adhered to the separation plate 36 readily or simply without adjusting one lateral edge of a row of the recesses 39 in a longitudinal direction of the tape 38 to be symmetrical with another lateral edge of the row of the recesses 39 in the longitudinal direction of the tape 38.

As described above with referring to FIGS. 8A and 8B, the narrow, elongated recesses 39 are disposed on the conveyance path side face 36*p* of the separation plate 36 in the recess span S2 defined from the front end 36*f* of the separation plate 36 that is disposed opposite the fixing nip N to the rear end 36*r* of the separation plate 36 in the sheet conveyance direction DS and at least in the conveyance span in the width direction of the sheet S that is perpendicular to the sheet conveyance direction DS. The sheet S is conveyed over the separation plate 36 in the conveyance span.

Figure 16:
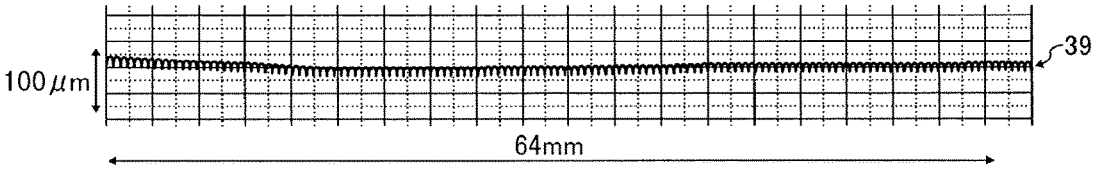
FIG. 16 is a diagram illustrating a front end profile of the recesses depicted in FIG. 11.

FIG. 16 is a diagram illustrating a front end profile, in the direction perpendicular to the surface of the sheet S, of the recesses 39 on the conveyance path side face 36*p* of the separation plate 36 of the separation device 60 at least in the conveyance span in the longitudinal direction of the separation plate 36 where the sheet S is conveyed over the separation plate 36. As illustrated in FIG. 3A, the comparative recesses 39C have the local, peculiar projections 90 that may produce the gloss streaks GS illustrated in FIG. 3B. Conversely, as illustrated in FIG. 16, the recesses 39 of the fixing device 25 do not have peculiar projections.

A description is provided of advantages of a separation device (e.g., the separation device 60).

As illustrated in FIGS. 2 and 4, the separation device separates a recording medium (e.g., a sheet S) bearing a toner image (e.g., a toner image T) that is ejected from a fixing nip (e.g., the fixing nip N) from a first rotator (e.g., the fixing belt 26). The fixing nip is formed between the first rotator disposed opposite the toner image on the recording medium and a second rotator (e.g., the pressure roller 27) pressed against the first rotator.

As illustrated in FIGS. 8A, 8B, and 9B, the separation device includes a separator (e.g., the separation plate 36) and a plurality of recesses (e.g., the recesses 39). The separator is disposed downstream from the fixing nip formed between the first rotator and the second rotator in a recording medium conveyance direction (e.g., the sheet conveyance direction DS). The separator separates the recording medium ejected from the fixing nip from the first rotator. The separator includes a conveyance path side face (e.g., the conveyance path side face 36*p*) over which the recording medium is conveyed. The plurality of recesses is disposed on the conveyance path side face of the separator in a recess span (e.g., the recess spans S1 and S2) defined from a front end (e.g., the front end 36*f*) disposed opposite the fixing nip to a rear end (e.g., the rear end 36*r*) of the separator that is disposed downstream from the front end in the recording medium conveyance direction and at least in a conveyance span defined by a width of the recording medium in a direction perpendicular to the recording medium conveyance direction. The recording medium is conveyed in the conveyance span.

As illustrated in FIG. 11, the plurality of recesses includes a first recess (e.g., the first recess 39A) and a second recess (e.g., the second recess 39B) adjacent to the first recess in the direction perpendicular to the recording medium conveyance direction. The first recess extends in a first extension line (e.g., the extension line 39Ae) that is oblique relative to the recording medium conveyance direction. The second recess extends in a second extension line (e.g., the extension line 39Be) that is oblique relative to the recording medium conveyance direction. The first extension line of the first recess overlaps the second extension line of the second recess in the direction perpendicular to the recording medium conveyance direction to define an overlap span (e.g., the overlap span V).

According to this exemplary embodiment, the plurality of recesses is disposed on the conveyance path side face of the separator in the recess span defined from the front end of the separator disposed opposite the fixing nip to the rear end of the separator in the recording medium conveyance direction and at least in the conveyance span on the separator where the recording medium ejected from the fixing nip is conveyed. Accordingly, the recesses reduce the area of the separator where the separator contacts the recording medium to separate the recording medium from the first rotator, suppressing resistance or friction between the separator and the recording medium as the recording medium slides over the separator. Consequently, the recesses prevent the recording medium from being jammed by the separator and prevent gloss streaks from appearing on the toner image on the recording medium.

As illustrated in FIG. 11, each of the first recess and the second recess extends obliquely relative to the recording medium conveyance direction. For example, the first extension line of the first recess and the second extension line of the second recess adjacent to the first recess overlap in the direction perpendicular to the recording medium conveyance direction to define the overlap span. Accordingly, the recesses do not mark projections and depressions on a part of the toner image on the recording medium.

Further, the recesses prevent a solid toner image on the recording medium from adhering to the separator as the recording medium is ejected from fixing nip and separated from the first rotator and prevent formation of gloss streaks on the toner image on the recording medium.

According to the exemplary embodiments described above, the fixing belt 26 serves as a first rotator. Alternatively, a fixing roller, a fixing film, a fixing sleeve, or the like may be used as a first rotator. Further, the pressure roller 27 serves as a second rotator. Alternatively, a pressure belt or the like may be used as a second rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A separation device comprising:

a separator, disposed downstream from a fixing nip formed between a first rotator and a second rotator in a recording medium conveyance direction, to separate a recording medium bearing a toner image that is ejected from the fixing nip from the first rotator, the separator including:

a conveyance path side face over which the recording medium is conveyed;

a front end disposed opposite the fixing nip; and a rear end disposed downstream from the front end in the recording medium conveyance direction; and a plurality of recesses disposed on the conveyance path side face of the separator in a recess span defined from the front end to the rear end of the separator in the recording medium conveyance direction and at least in a conveyance span defined by a width of the recording medium in a direction perpendicular to the recording medium conveyance direction, the conveyance span where the recording medium is conveyed, the plurality of recesses including:

a first recess extending in a first extension line that is oblique relative to the recording medium conveyance direction; and a second recess being adjacent to the first recess in the direction perpendicular to the recording medium conveyance direction and extending in a second extension line that is oblique relative to the recording medium conveyance direction and overlaps the first extension line of the first recess in the direction perpendicular to the recording medium conveyance direction to define an overlap span, wherein each of the plurality of recesses includes a first end facing in a direction of the front end of the separator, and includes a second end facing in a direction of the rear end of the separator.

2. The separation device according to claim 1, wherein the front end of the separator includes a sheet.

3. The separation device according to claim 2, wherein the conveyance path side face of the separator includes a surface layer that facilitates sliding of the recording medium over the separator and mounts the plurality of recesses.

4. The separation device according to claim 3, wherein the surface layer of the separator includes a tape made of fluoro resin.

5. The separation device according to claim 4, wherein the tape coats at least the front end of the separator.

6. The separation device according to claim 5, wherein a combined thickness of the tape and the front end of the separator is 0.6 mm.

7. The separation device according to claim 5, wherein the separator further includes a first rotator side face being disposed opposite the first rotator and including the tape.

8. The separation device according to claim 1, wherein the separator further includes a single plate extending in a longitudinal direction of the separator.

9. The separation device according to claim 1, wherein each of the plurality of recesses has a depth not smaller than 5 micrometers.

10. The separation device according to claim 1, wherein the first recess is adjacent to the second recess with a pitch not greater than 1.2 nm.

11. The separation device according to claim 1, wherein the plurality of recesses is treated with deburring press.

12. The separation device according to claim 1, wherein each of the first extension line of the first recess and the second extension line of the second recess is inclined relative to the recording medium conveyance direction by one of 30 degrees, 45 degrees, and 60 degrees.

13. A fixing device comprising:

a first rotator disposed opposite a toner image on a recording medium;

a second rotator pressed against the first rotator to form a fixing nip between the first rotator and the second rotator, the fixing nip through which the recording medium is conveyed;

a separator, disposed downstream from the fixing nip in a recording medium conveyance direction, to separate the recording medium ejected from the fixing nip from the first rotator, the separator including:

a conveyance path side face over which the recording medium is conveyed;

a front end disposed opposite the fixing nip; and a rear end disposed downstream from the front end in the recording medium conveyance direction; and a plurality of recesses disposed on the conveyance path side face of the separator in a recess span defined from the front end to the rear end of the separator in the recording medium conveyance direction and at least in a conveyance span defined by a width of the recording medium in a direction perpendicular to the recording medium conveyance direction, the conveyance span where the recording medium is conveyed, the plurality of recesses including:

a first recess extending in a first extension line that is oblique relative to the recording medium conveyance direction; and a second recess being adjacent to the first recess in the direction perpendicular to the recording medium conveyance direction and extending in a second extension line that is oblique relative to the recording medium conveyance direction and overlaps the first extension line of the first recess in the direction perpendicular to the recording medium conveyance direction to define an overlap span, wherein each of the plurality of recesses includes a first end facing in a direction of the front end of the separator, and includes a second end facing in a direction of the rear end of the separator.

14. The fixing device according to claim 13, wherein a gap between the first rotator and the front end of the separator increases from a center to each lateral end of the separator in the direction perpendicular to the recording medium conveyance direction.

15. An image forming apparatus comprising:

an image forming device to form a toner image; and a fixing device disposed downstream from the image forming device in a recording medium conveyance direction to fix the toner image on a recording medium, the fixing device including:

a first rotator disposed opposite the toner image on the recording medium;

a second rotator pressed against the first rotator to form a fixing nip between the first rotator and the second rotator, the fixing nip through which the recording medium is conveyed;

a separator, disposed downstream from the fixing nip in the recording medium conveyance direction, to separate the recording medium ejected from the fixing nip from the first rotator, the separator including:

a conveyance path side face over which the recording medium is conveyed;

a front end disposed opposite the fixing nip; and a rear end disposed downstream from the front end in the recording medium conveyance direction; and a plurality of recesses disposed on the conveyance path side face of the separator in a recess span defined from the front end to the rear end of the separator in the recording medium conveyance direction and at least in a conveyance span defined by a width of the recording medium in a direction perpendicular to the recording medium conveyance direction, the conveyance span where the recording medium is conveyed, the plurality of recesses including:

a first recess extending in a first extension line that is oblique relative to the recording medium conveyance direction; and a second recess being adjacent to the first recess in the direction perpendicular to the recording medium conveyance direction and extending in a second extension line that is oblique relative to the recording medium conveyance direction and overlaps the first extension line of the first recess in the direction perpendicular to the recording medium conveyance direction to define an overlap span, wherein each of the plurality of recesses includes a first end facing in a direction of the front end of the separator, and includes a second end facing in a direction of the rear end of the separator.

* * * * *